US010305162B2

(12) United States Patent
Ortigosa et al.

(10) Patent No.: US 10,305,162 B2
(45) Date of Patent: May 28, 2019

(54) BROADBAND ANTENNA SYSTEM FOR A VEHICLE

(71) Applicant: Advanced Automotive Antennas, S.L.U., Barcelona (ES)

(72) Inventors: Enrique Martinez Ortigosa, Barcelona (ES); Victor Diaz Jimenez, London (GB); Ramiro Quintero Illera, Barcelona (ES)

(73) Assignee: ADVANCED AUTOMOTIVE ANTENNAS, S.L.U., Barcelona (ES)

( * ) Notice: Subject to any disclaimer, the term of this patent is extended or adjusted under 35 U.S.C. 154(b) by 0 days.

(21) Appl. No.: 15/649,156

(22) Filed: Jul. 13, 2017

(65) Prior Publication Data

US 2018/0019512 A1 Jan. 18, 2018

(30) Foreign Application Priority Data

Jul. 14, 2016 (EP) ..... 16382335

(51) Int. Cl.
*H01Q 1/32* (2006.01)
*H01Q 1/12* (2006.01)
(Continued)

(52) U.S. Cl.
CPC ..... *H01Q 1/1214* (2013.01); *H01Q 1/241* (2013.01); *H01Q 1/3275* (2013.01); *H01Q 1/36* (2013.01); *H01Q 1/42* (2013.01); *H01Q 5/30* (2015.01); *H01Q 5/378* (2015.01); *H01Q 9/40* (2013.01); *H01Q 5/364* (2015.01)

(58) Field of Classification Search
CPC ..... H01Q 1/1214; H01Q 5/30; H01Q 1/241; H01Q 1/3275; H01Q 1/42; H01Q 1/36; H01Q 9/40; H01Q 1/3291; H01Q 1/282; H01Q 1/325
See application file for complete search history.

(56) References Cited

U.S. PATENT DOCUMENTS 6,603,429 B1 * 8/2003 Bancroft ..... H01Q 1/243 343/700 MS
2002/0163470 A1 11/2002 Nagumo et al.
(Continued)

FOREIGN PATENT DOCUMENTS

DE 102014013926 A1 3/2016

OTHER PUBLICATIONS

European Search Report from the European Patent Office for EP Application No. 16382335.4, dated Jan. 23, 2017, 8 pages.

*Primary Examiner* — Dieu Hien T Duong
(74) *Attorney, Agent, or Firm* — Cantor Colburn LLP

(57) ABSTRACT

A broadband antenna system for a vehicle, comprising a ground plane circumscribed by a rectangle having major and minor sides, a dielectric substrate comprising a first portion area, a radiating element for operating at a frequency band and having at least three angles and three sides, a first side being substantially aligned with one side of the rectangle, and a first angle having an apex being the closest point of the radiating element to the ground plane, and a conductive element having at least a first portion extending between the radiating element and one side of the first portion area, wherein each major side has an electric length of at least 0.13λ, being λ the lowest frequency of the antenna system, and the first angle having an aperture lower than 156°.

14 Claims, 20 Drawing Sheets

(51) Int. Cl.

| | |
|---|---|
| ***H01Q 5/30*** | (2015.01) |
| ***H01Q 1/24*** | (2006.01) |
| ***H01Q 1/42*** | (2006.01) |
| ***H01Q 1/36*** | (2006.01) |
| ***H01Q 9/40*** | (2006.01) |
| ***H01Q 5/378*** | (2015.01) |
| *H01Q 5/364* | (2015.01) |

(56) References Cited

U.S. PATENT DOCUMENTS

| | | | | |
|---|---|---|---|---|
| 2005/0195124 | A1* | 9/2005 | Puente Baliarda | H01Q 1/36 343/893 |
| 2005/0219127 | A1* | 10/2005 | Nakano | H01Q 1/40 343/700 MS |
| 2010/0013719 | A1* | 1/2010 | Yen | H01Q 1/243 343/702 |
| 2012/0001815 | A1 | 1/2012 | Wong et al. | |
| 2013/0009836 | A1* | 1/2013 | Islam | H01Q 1/241 343/810 |
| 2014/0085159 | A1 | 3/2014 | Wong et al. | |
| 2015/0061961 | A1* | 3/2015 | Bayram | H01Q 1/243 343/862 |
| 2016/0172758 | A1 | 6/2016 | Puente Baliarda et al. | |
| 2017/0054204 | A1* | 2/2017 | Changalvala | H01Q 1/3291 |

* cited by examiner

BROADBAND ANTENNA SYSTEM FOR A VEHICLE

CROSS-REFERENCE TO RELATED APPLICATION

This application claims priority to European patent application no. EP16382335.4, filed on Jul. 14, 2016, the disclosure of which is incorporated herein by reference in its entirety.

BACKGROUND

Traditionally, vehicles have been provided with antennas mounted in different locations of the vehicle. Usually, these antennas were broadband monopoles located at the rear window and/or on the roof.

FIG. 1*a* shows a lateral view of a vehicle having a conventional antenna 12 mounted on the roof of the vehicle. FIG. 1*b* shows a detailed view of the antenna 12 shown in FIG. 1*a*, where the antenna 12 is fed by a coaxial cable 14 and the roof acts as a ground plane 13.

Over the years, the number of radio-communication services has increased and, in consequence, the number of antennas required for providing these services.

Also, aesthetic and aerodynamic trends have changed and, over the years, satisfying customer tastes has become essential in the automotive industry. Lately, customer tastes generally lead to vehicles having a streamlined and smooth appearance, which interfere with providing the vehicle with multiple and dispersed antennas.

Thus, both for meeting customer tastes and providing all the radio-communication services possibly demanded by the driver, the automotive industry is tending to integrate in a single module all the communication modules specifically designed for providing one communication service, such as telephony, AM/FM radio, satellite digital audio radio services (SDARS), global navigation satellite system (GNSS), or digital audio broadcasting (DAB).

The integration of multiple antenna units in a single global antenna module leads to achieve great advantages in costs, quality and engineering development time.

This global antenna module is subject to meet current customer tastes. For that, it would be desirable to reduce the size of traditional antenna systems in order to be able to integrate them in a module that can maintain the streamlined appearance of the vehicle. However, reducing the size of an antenna system affects its performance.

Further, the automotive industry has to meet customer demands on communication, being thus obliged to provide robust communications in all services available for the driver. For that, it would be desirable to provide an antenna system able to operate in a broad bandwidth with high efficiency.

Then, it would be desirable to develop an improved antenna system for a vehicle that having a reduced size, offers a high efficiency and a broadband behavior. It would be also desirable that the improved antenna system operates on all LTE frequency bands without losing its broadband and high efficient characteristics in any band.

BRIEF DESCRIPTION OF THE INVENTION

The present invention overcomes the above mentioned drawbacks by providing a new design of a broadband antenna system for a vehicle, which having a reduced size is capable of providing a high bandwidth and a high efficiency, also at all LTE frequency bands.

In one aspect of the invention, the broadband antenna system for a vehicle comprises a radiating element for operating at at least one frequency band of operation and disposed on at least a first portion area of a dielectric material, a substrate, a conductive element disposed on that first portion area, a grounding point, a feeding element, and a ground plane circumscribed by a rectangle having said circumscribed rectangle minor and major sides.

The ground plane could be disposed in the same substrate with the radiating element, disposed on a second portion area of the substrate, or disposed perpendicular to the radiating element, outside the substrate.

The radiating element has at least three angles and at least three sides, a first side being substantially aligned with one side of the circumscribed rectangle and a first angle having an apex, said apex being the closest point of the radiating element to the ground plane.

The conductive element has at least a first portion extending between one of the sides of the first portion area of the substrate and the radiating element. The conductive element is electrically isolated from the radiating element, having no electric connection therebetween. Further, the conductive element is coupled to ground plane through the grounding point.

The grounding point is disposed at one extreme of the first portion area of the substrate. The feeding element is electromagnetically coupled with the radiating element through the apex of the first angle.

Additionally, each major side of the ground plane has an electric length (Lgp) of at least 0.13λ, being λ the lowest frequency of the antenna's band operation, and the first angle of the radiating element having an aperture lower than 156°, said aperture preferably ranging from 80° to 156°, having an optimum range from 120° to 156° and with a optimum aperture value of 150°.

Preferably, the conductive element has an electric length, and the sum of the electric length of the major side of the ground plane and the electric length of the conductive element ranges from 0.18λ to 0.22λ, being λ the lowest frequency of the antenna's band operation.

According to a preferred embodiment, the radiating element has a length measured from the first side to the first angle lower than 1/10λ, and a width measured as the length of the first side of the radiating element lower than 1/8λ, being λ the lowest frequency of the antenna's band operation.

Also, according to a preferred embodiment, the first portion of the conductive element is bigger than 1/8λ, being λ the lowest frequency of the antenna's band operation.

Providing the radiating element and the conductive element as described, the antenna system modifies the electric length of the ground plane, modifying its frequency behaviour. This modified frequency behaviour brings the resonance of the ground plane to lower frequencies, surging a new resonant frequency, which in case of the radiating element operates at the LTE frequency band of operation, a new resonant frequency surges at the LTE 700 band.

For instance, for the LTE frequency band of operation, the invention provides an antenna system capable of covering the lowest frequencies of LTE on a ground plane of reduced dimensions, in particular, on a ground plane of at least 0.13λ, being λ the lowest frequency of the antenna's band operation, i.e. λ=700 MHz (ground plane: 55.9 mm).

Thus, in the LTE case, the invention provides a broadband antenna system having high efficient characteristics, such as:

very high bandwidth (BW) covering the Low Frequency region: 700-960 MHz, and the High Frequency region: 1600-2900 MHz;

relative BW (Low Frequency region: 31%, High frequency region: 57%);

Voltage Standing Wave Ratio (VSWR)<2.5 on the 95% of the BW;

High Efficiency (Low Frequency region >80%. High Frequency region: ≈80%);

very compact solution: being able to be integrated on a ground plane of at least 55×55 mm.

In another aspect of the invention, a shark fin antenna comprises the broadband antenna system of the invention and a cover for enclosing said antenna system.

The invention can provide a new design of an antenna system, specifically designed for being installed on a vehicle, and preferably, for operating on the LTE network. This new antenna is also designed for being capable of integrating different antennas to provide additional communication services.

In some embodiments, the invention can provide an antenna system having a broad bandwidth behavior, which is capable of offering a high efficiency, and which is capable of reducing the size of existing antenna systems for vehicles.

In some embodiments, the invention can provide an antenna system capable of covering all the 4G frequency bands, ensuring that the antenna maintains the desired behavior at the whole band of operation, and in particular, at the lower LTE frequency range 700-800 MHz.

In some embodiments, the invention can provide an antenna system capable of being integrated with other vehicle radio-communication services in a single compact shark fin antenna module.

BRIEF DESCRIPTION OF THE DRAWINGS

For a better comprehension of the invention, the following drawings are provided for illustrative and non-limiting purposes, wherein:

FIG. 1*a* shows the antenna installed on the roof of a vehicle, and FIG. 1*b* shows a detailed view of the antenna of FIG. 1*a*.

DETAILED DESCRIPTION OF THE INVENTION

Figure 1A:
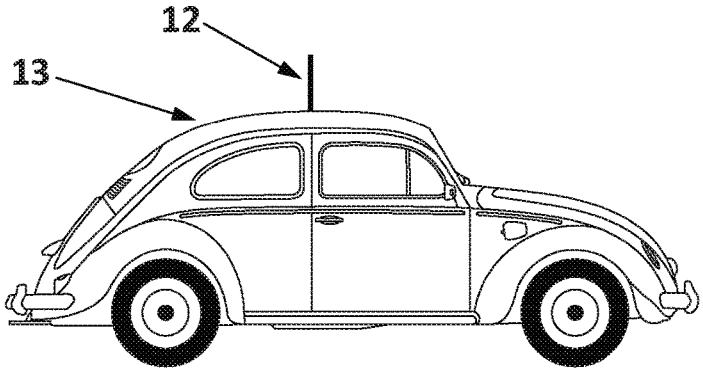
FIG. 1a (PRIOR ART)
FIGS. 1*a* and 1*b* show lateral views of a prior art vehicle monopole antenna.
Figure 1B:
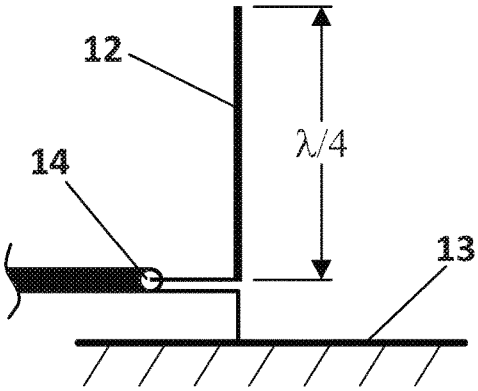
FIG. 1b (PRIOR ART)
Figure 2:
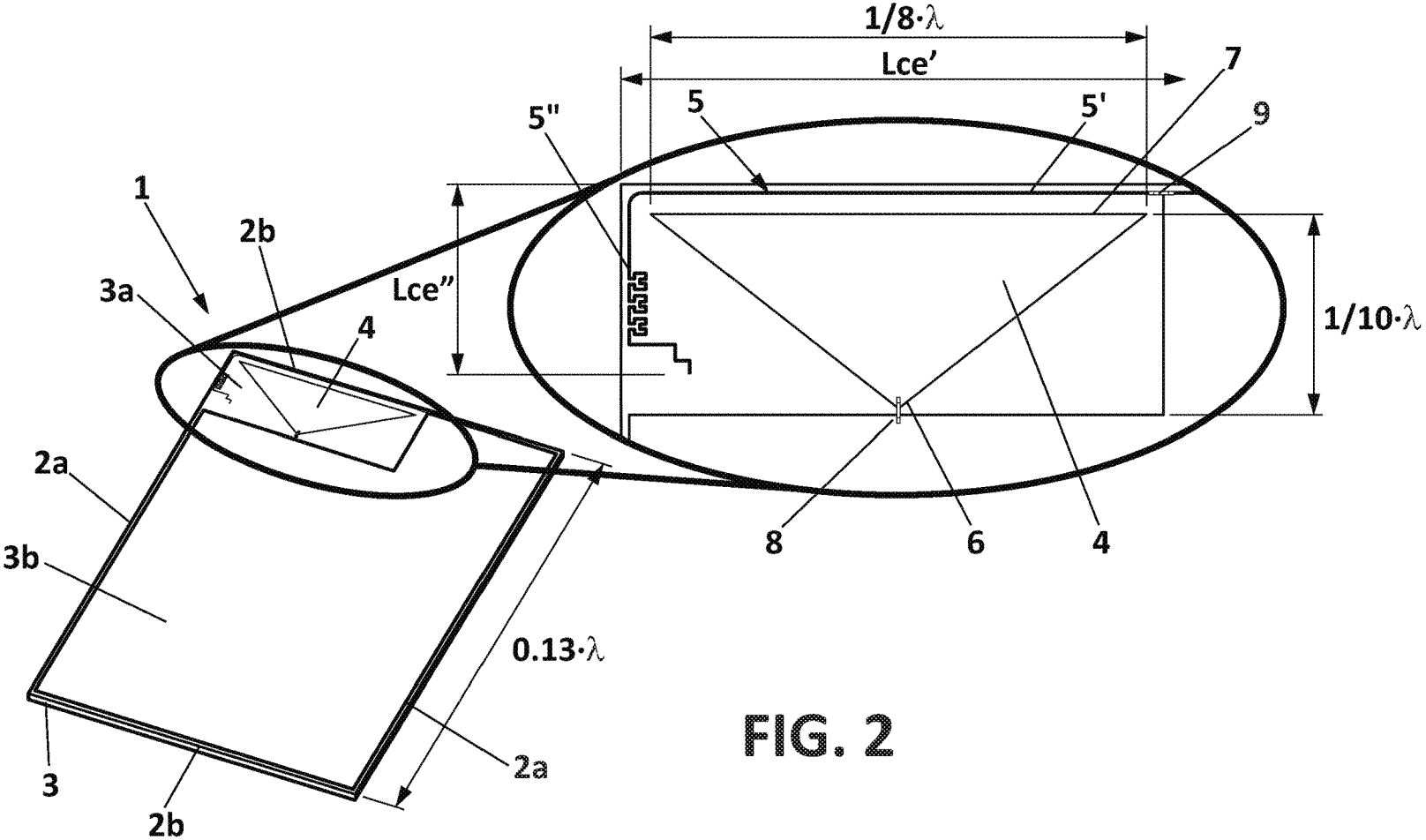
FIG. 2 shows a perspective and detailed view of a broadband antenna system, according to a first embodiment of the invention.

FIG. 2 shows a broadband antenna system 1 for a vehicle, according to a first embodiment of the invention. As shown, the antenna system 1 comprises a ground plane 2, first and second portion areas 3*a*, 3*b* of a dielectric substrate 3, a radiating element 4 for operating at a LTE frequency band, a conductive element 5, and a feeding 8 and a grounding point 9.

The ground plane 2 has a rectangular configuration, having major 2*a* and minor 2*b* sides. The ground plane 2 is disposed on the second portion area 3*b* of the substrate 3, while the radiating element 4 is disposed on the first portion area 3*a* of the substrate 3.

In this first embodiment, the ground plane 2 and the radiating element 4 are on the same substrate 3 and can be formed into a single body, where the second portion area 3*b* of the substrate 3 allocates the ground plane 2, and the first portion area 3*a* of the substrate 3 allocates the radiating element 4. Further, the first portion area 3*a* of the substrate 3 allocates the conductive element 5, the grounding point 9, and the feeding element 8.

The first portion area 3*a* is disposed on a corner of the substrate 3 and the second portion area 3*b* is disposed on the rest of the substrate 3.

The grounding point 9 is disposed at the upper extreme of the first portion area 3*a* of the substrate 3, and preferably at the interface between the first 3*a* and the second portion area 3*b* of the substrate 3. The grounding point 9 is coupled to the ground plane 2. The feeding element 8 is adapted to feed the radiating element 4, and is electromagnetically coupled with said radiating element 4.

The radiating element 4 has at least three angles and three sides, a first side 7 is aligned with the upper minor side 2*b* of the ground plane 2, and a first angle 6 whose vertex is the closest point to the ground plane 2. Further, the first angle 6 is opposite to the midpoint of the first side 7, wherein the first side 7 is the longer side of the radiating element 4. The first angle 6 has an aperture lower than 156°, 150° in the embodiment. In FIG. 2, the radiating element 4 has a substantially triangular configuration, however, other configurations are possible.

As shown in the detailed view of FIG. 2, the conductive element 5 is disposed on the first portion area 3*a* of the substrate 3, and is electrically isolated from the radiating element 4. The conductive element 5 has a first portion 5' extending between the upper side of the first portion area 3*a* of the substrate 3 and the radiating element 4, and a second portion 5" extending between the left side of the first portion area 3*a* of the substrate 3 and the radiating element 4.

Preferably, the first portion 5' of the conductive element 5 is bigger than ⅛λ, being λ the lowest frequency of the at least one LTE frequency band of operation of the broadband antenna system 1.

Also, the first portion 5' of the conductive element 5 is preferably spaced 50 μm from the radiating element 4.

Preferably, as shown in FIG. 2, one extreme of the conductive element 5 is coupled to the ground plane 2 through the grounding point 9, and the other extreme is open, having a space-filling curve configuration. The space-filling curve configuration allows reducing the length of the conductive element 5.

For purposes of describing this invention, space-filling curve should be understood as defined in U.S. Pat. No. 7,868,834B2, in particular, in paragraphs [0061]-[0063], and FIG. 10.

Figure 3:
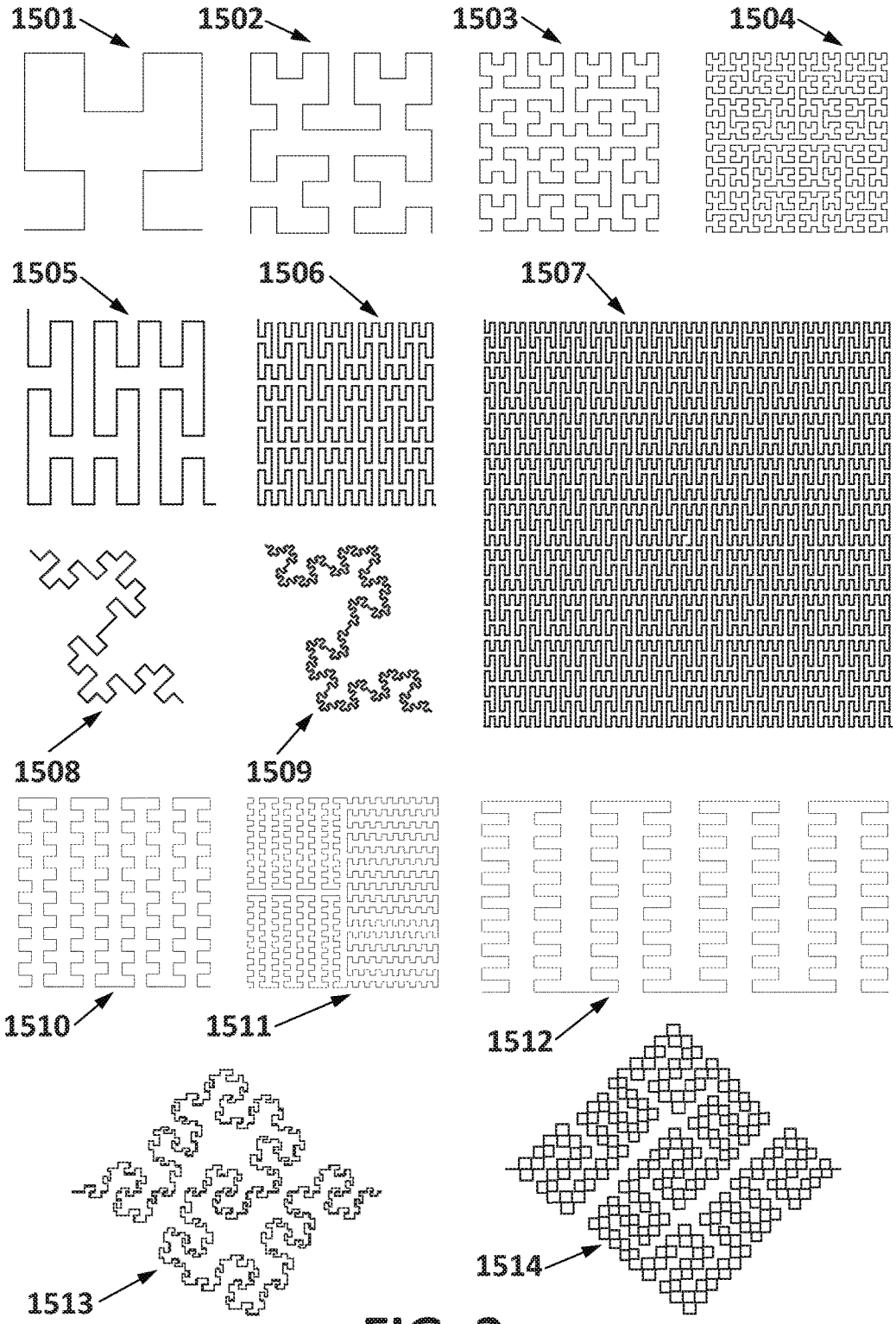
FIG. 3 shows examples of space-filling curves that can be added to reduce the length of the conductive element.

One extreme of the conductive element 5 of the broadband antenna system described herein may be shaped as a space-filling curve. FIG. 3 shows examples of space-filling curves. Space-filling curves 1501 through 1514 are examples of space filling curves for antenna designs. Space-filling curves fill the surface or volume where they are located in an efficient way while keeping the linear properties of being curves.

A space-filling curve is a non-periodic curve including a number of connected straight segments smaller than a fraction of the operating free-space wave length, where the segments are arranged in such a way that no adjacent and connected segments form another longer straight segment and wherein none of said segments intersect each other.

In one example, an antenna geometry forming a space-filling curve may include at least five segments, each of the at least five segments forming an angle with each adjacent segment in the curve, at least three of the segments being shorter than one-tenth of the longest free-space operating wavelength of the antenna. Each angle between adjacent segments is less than 180° and at least two of the angles between adjacent sections are less than 115°, and at least two of the angles are not equal. The example curve fits inside a rectangular area, the longest side of the rectangular area being shorter than one-fifth of the longest free-space operating wavelength of the antenna. Some space-filling curves might approach a self-similar or self-affine curve, while some others would rather become dissimilar, that is, not displaying self-similarity or self-affinity at all (see for instance 1510, 1511, 1512).

The major side 2*a* of the ground plane 2 has an electric length (Lgp) of at least 0.13λ, being λ the lowest frequency of the at least one LTE frequency band of operation of the antenna system 1, i.e. 700 MHz (λ=43 cm).

The electric length of the ground plane (Lgp) is modified by the electric length (Lce) of the conductive element 5, which acts as an extensor of the ground plane. The electric length (Lce) of the conductive element 5 is the sum of the electric length of the first (Lce') and second portion (Lce") of the conductive element 5, that is, Lce=Lce'+Lce".

Preferably, the sum of the electric length (Lgp) of a major side (2*a*) of the ground plane 2 and the electric length (Lce) of the conductive element 5 ranges from 0.18λ, to 0.22λ, being λ the lowest frequency of the at least one LTE frequency band of operation of the antenna system.

Figure 4:
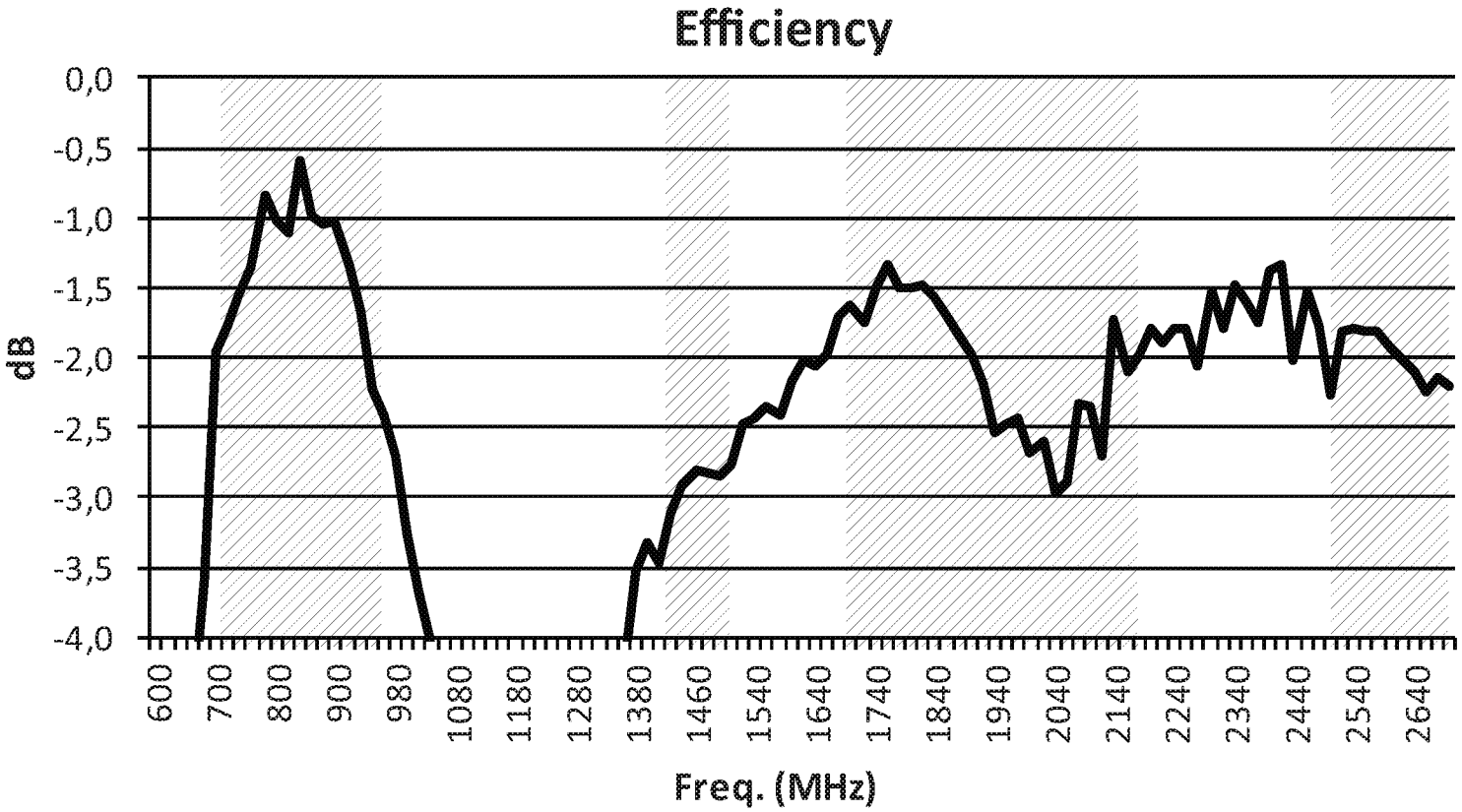
FIG. 4 shows a graphic of the efficiency of the broadband antenna system of FIG. 2.
Figure 5:
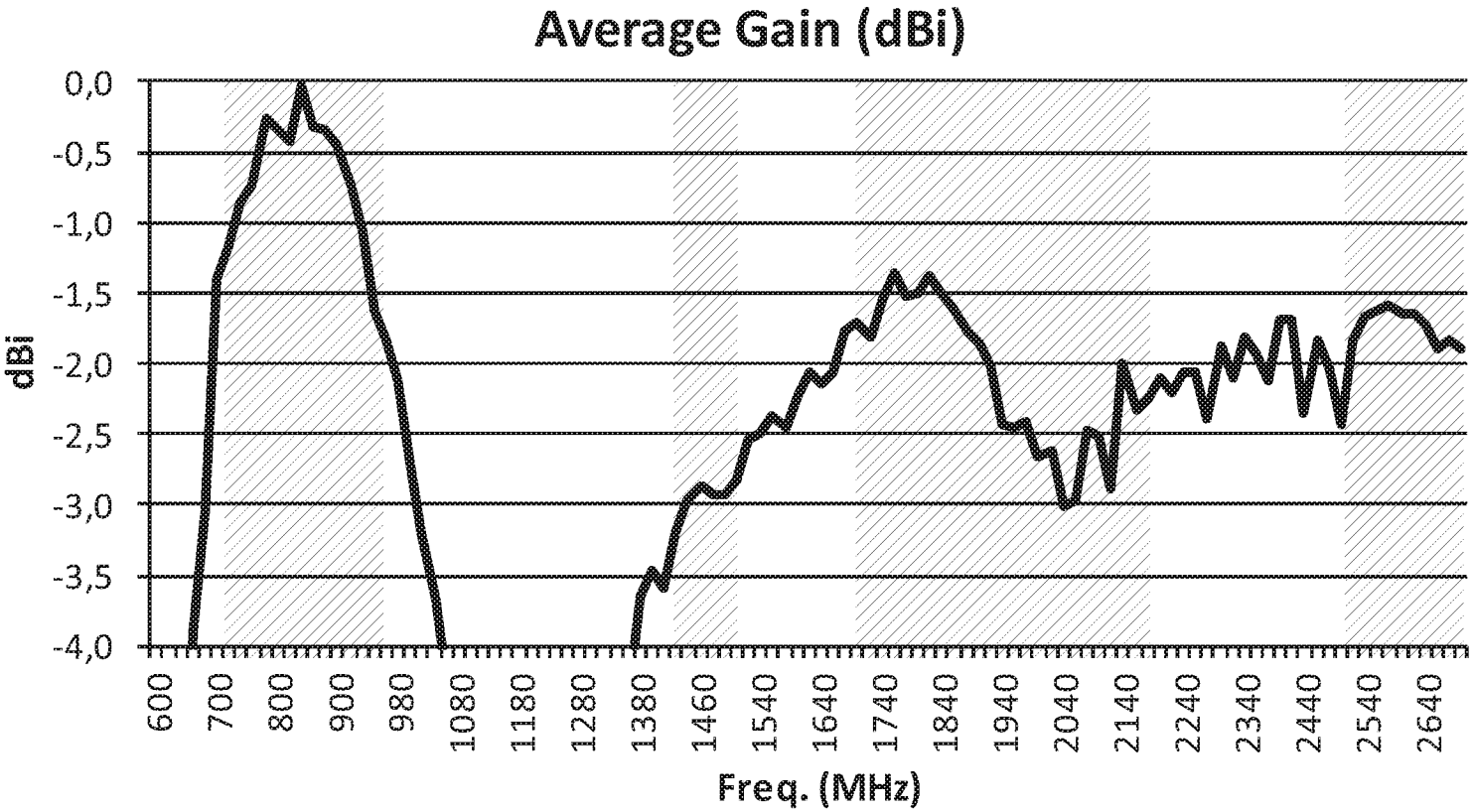
FIG. 5 shows a graphic of the average gain of the broadband antenna system of FIG. 2.
Figure 6:
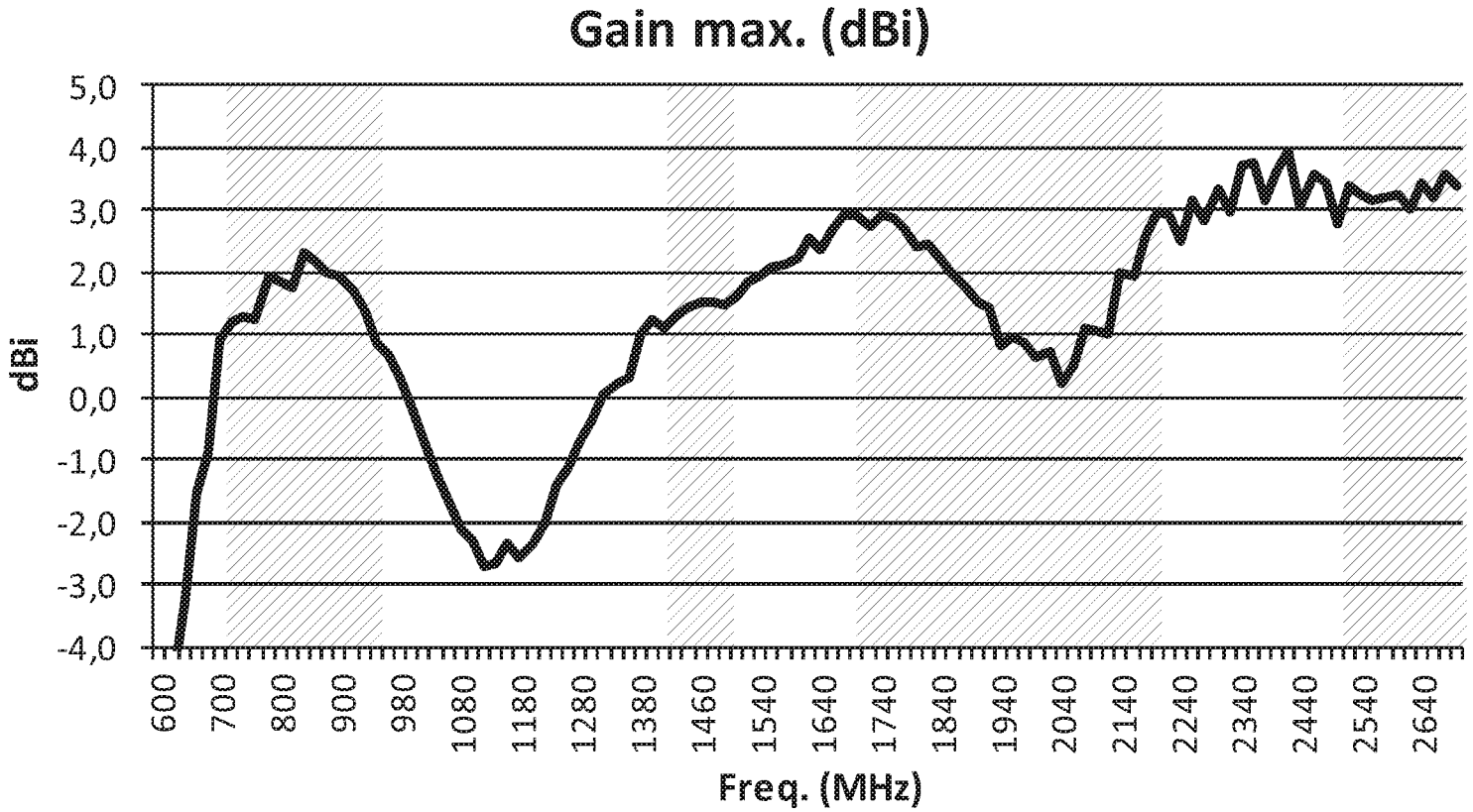
FIG. 6 shows a graphic of the maximum gain of the broadband antenna system of FIG. 2.

FIGS. 4-6 respectively show graphics of the efficiency, the average gain, and maximum gain of the broadband antenna system embodiment shown in FIG. 2.

As shown, the antenna system covers LTE frequency bands ranging from 700 MHz to 960 MHz with an efficiency greater than −2 dB, an average gain greater than −1.5 dBi and maximum gain greater than 1 dBi. Thus, the broadband antenna system satisfies customer requirements covering the lower 4G frequency bands (LTE 700/LTE 800) with good directivity and minor power losses (high efficiency) with better frequency response than current mobile phone antennas, which have 6 dB of losses.

Also, as shown in FIGS. 4-6, the antenna system covers the LTE frequency band ranging from 1400 MHz to 1500 MHz with an efficiency greater than −3 dB, an average gain greater than −3 dBi, and maximum gain greater than 1 dBi. Thus, the broadband antenna system provides a high-efficiency antenna.

FIGS. 4-6 also show that the antenna system at the LTE frequency band ranging from 1700 to 2200 MHz has an average efficiency greater than −2.5 dB, an average gain greater than −2.5 dBi, and maximum gain greater than 0 dBi. Gain values of the antenna system fulfil antenna's specification of telephony operators.

Also, the antenna system provides at the LTE frequency band ranging from 2500 to 2700 an efficiency greater than −2.5 dB, an average gain greater than −2 dBi, and maximum gain greater than 3 dB. Thus, the broadband antenna system provides very high directive and efficiency features at this range.

According to a second embodiment, the broadband antenna system 1 further comprises a matching network coupling the radiating element 4 with the feeding element 8. The matching network may consist on a transmission line or a multiple section of transmission lines.

Figure 7:
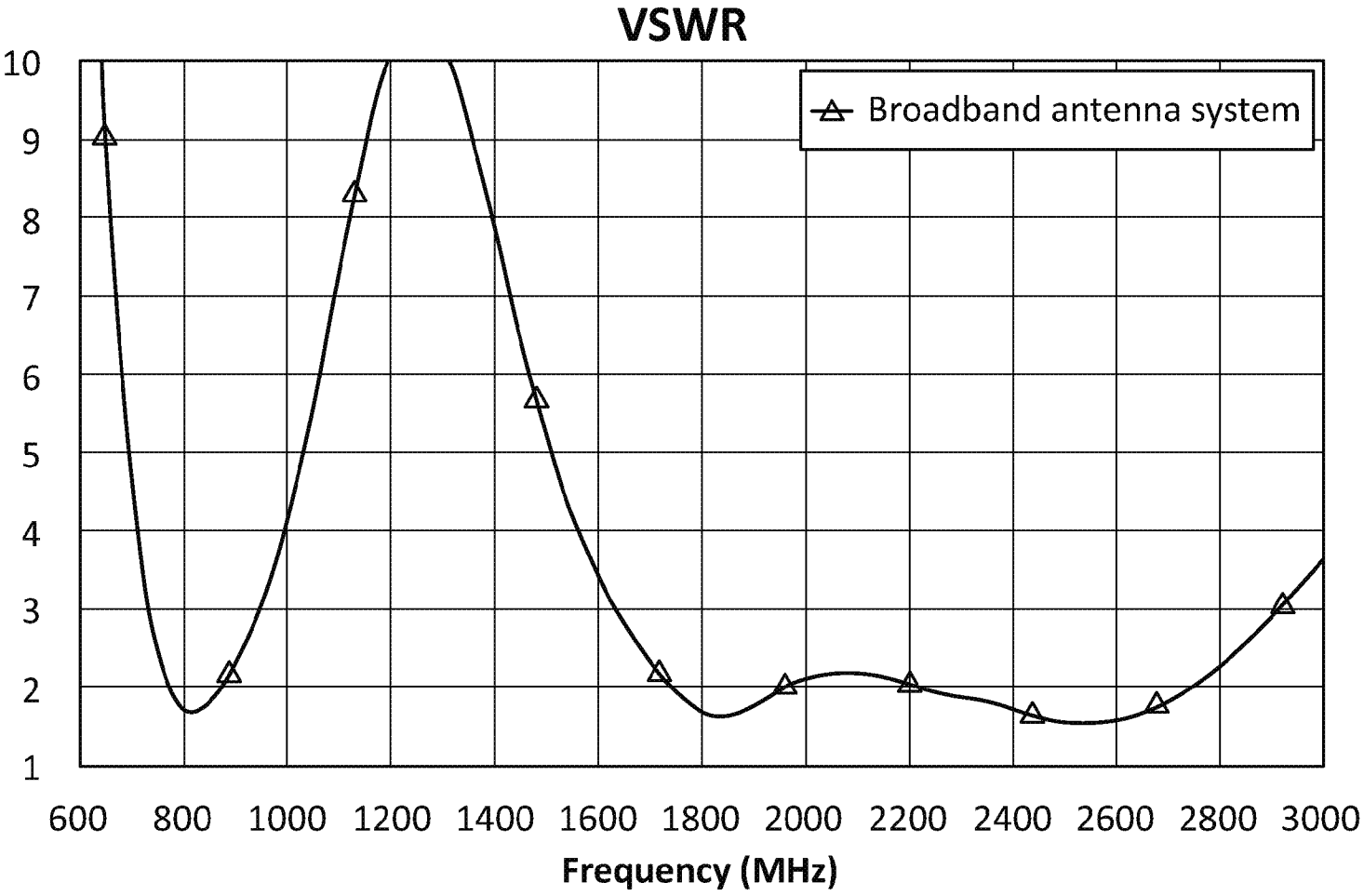
FIG. 7 shows a graphic of the Voltage Standing Wave Ratio (VSWR) of the broadband antenna system, according to a second embodiment of the invention.
Figure 8:
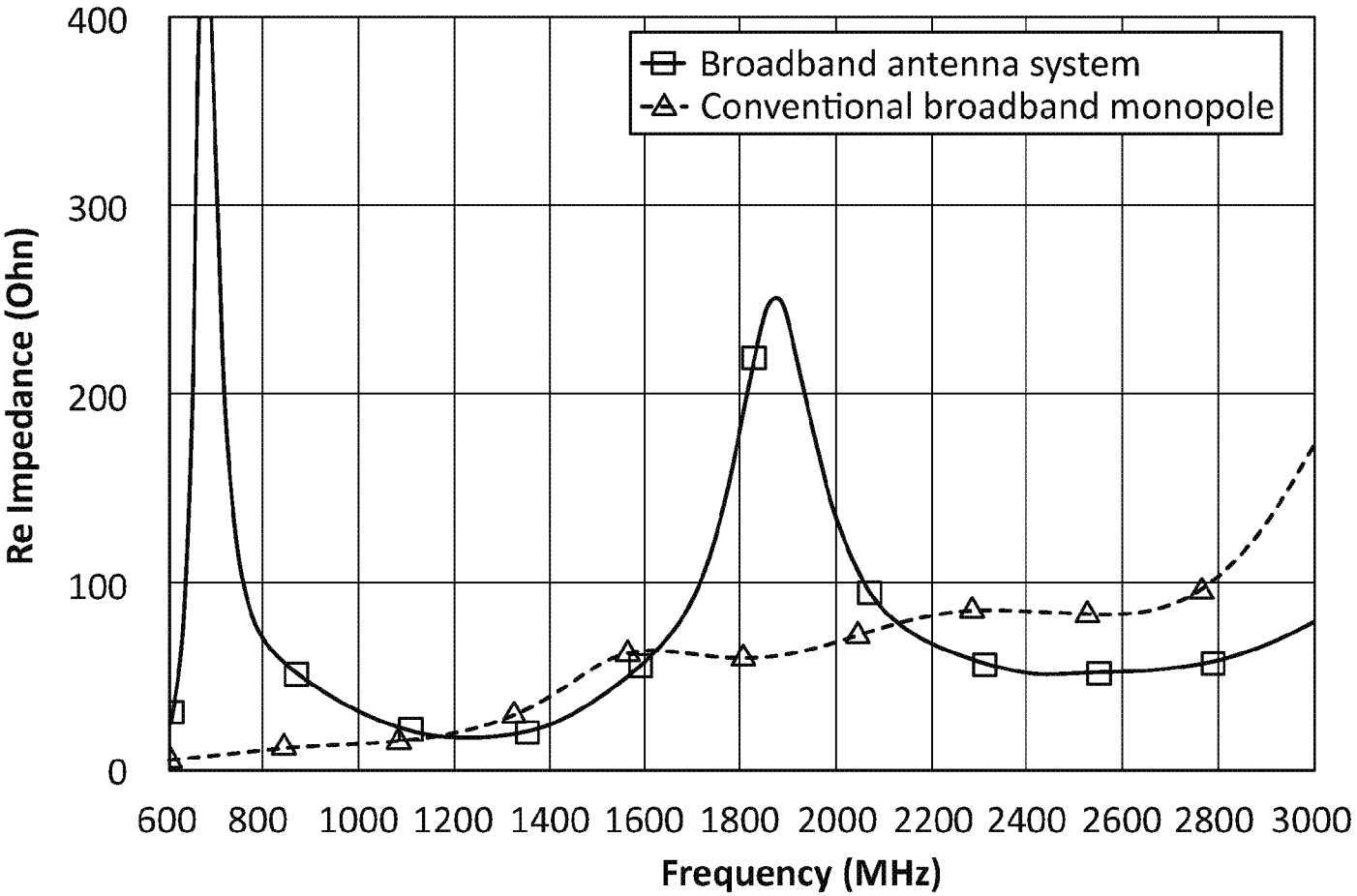
FIG. 8 shows a graphic of the real part of the impedance of a conventional broadband monopole, as shown in FIGS. 1*a* and 1*b* (dashed line) vs a broadband antenna system (continuous line), according to a second embodiment of the invention.
Figure 9:
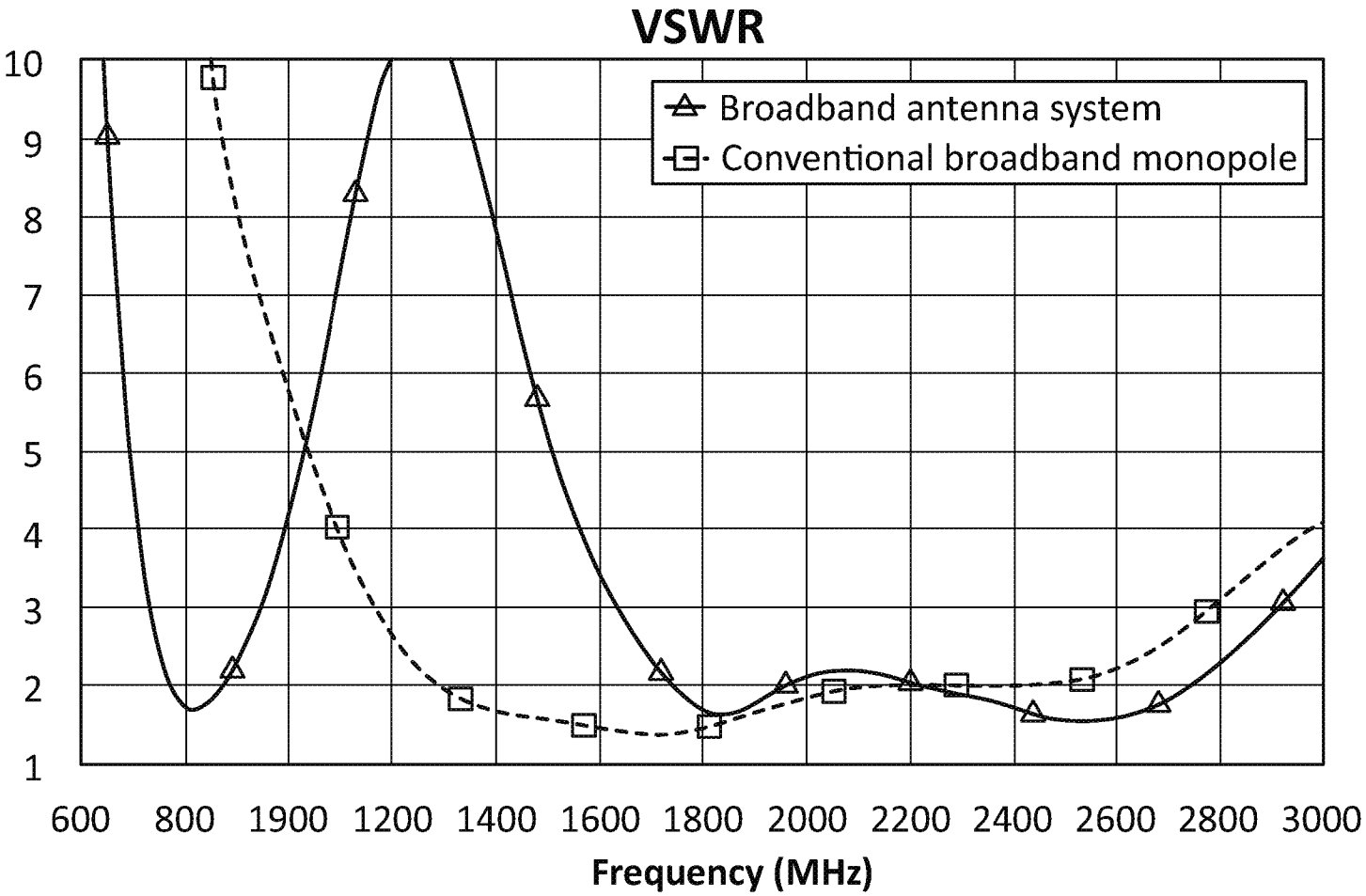
FIG. 9 shows a graphic of the VSWR of a conventional broadband monopole, as shown in FIGS. 1*a* and 1*b* (dashed line) vs a broadband antenna system (continuous line), according to a second embodiment of the invention.

According to this second embodiment, FIGS. 7-9 respectively show graphics of the broadband antenna system shown in FIG. 2 provided with a matching network.

FIG. 7 shows a graphic of the VSWR of the broadband antenna system provided with a matching network. As shown, the VSWR <2.5 on the 95% of the bandwidth (700-960 MHz, 1600-2900 MHz) of the antenna system. The antenna offers good VSWR in the low frequency region and broadband behaviour in the high frequency region.

FIG. 8 shows the real part of the impedance of a conventional broadband λ/4 monopole in a dashed line, and the real part of the impedance of the broadband antenna system of the invention in a continuous line. As shown, the value of the real part of the conventional monopole is lower than the desired 50 Ohm at the lower frequencies. The conductive element 5 of the broadband antenna system helps to increase the real part of the impedance at the lower frequencies of LTE, thus, allowing the communication at these frequencies. Thus, the broadband antenna system increases the antenna's impedance and generates a double frequency response.

FIG. 9 shows the VSWR measurement of a conventional broadband λ/4 monopole in a dashed line, and the VSWR measurement of the broadband antenna system of the invention in a continuous line. As shown, the new antenna system modifies the resonance frequency positions with respect to the conventional broadband monopole, getting an extended band of operation. The matching network allows reducing the absolute magnitude of the imaginary part of the impedance in order to achieve a good VSWR result.

Figure 10:
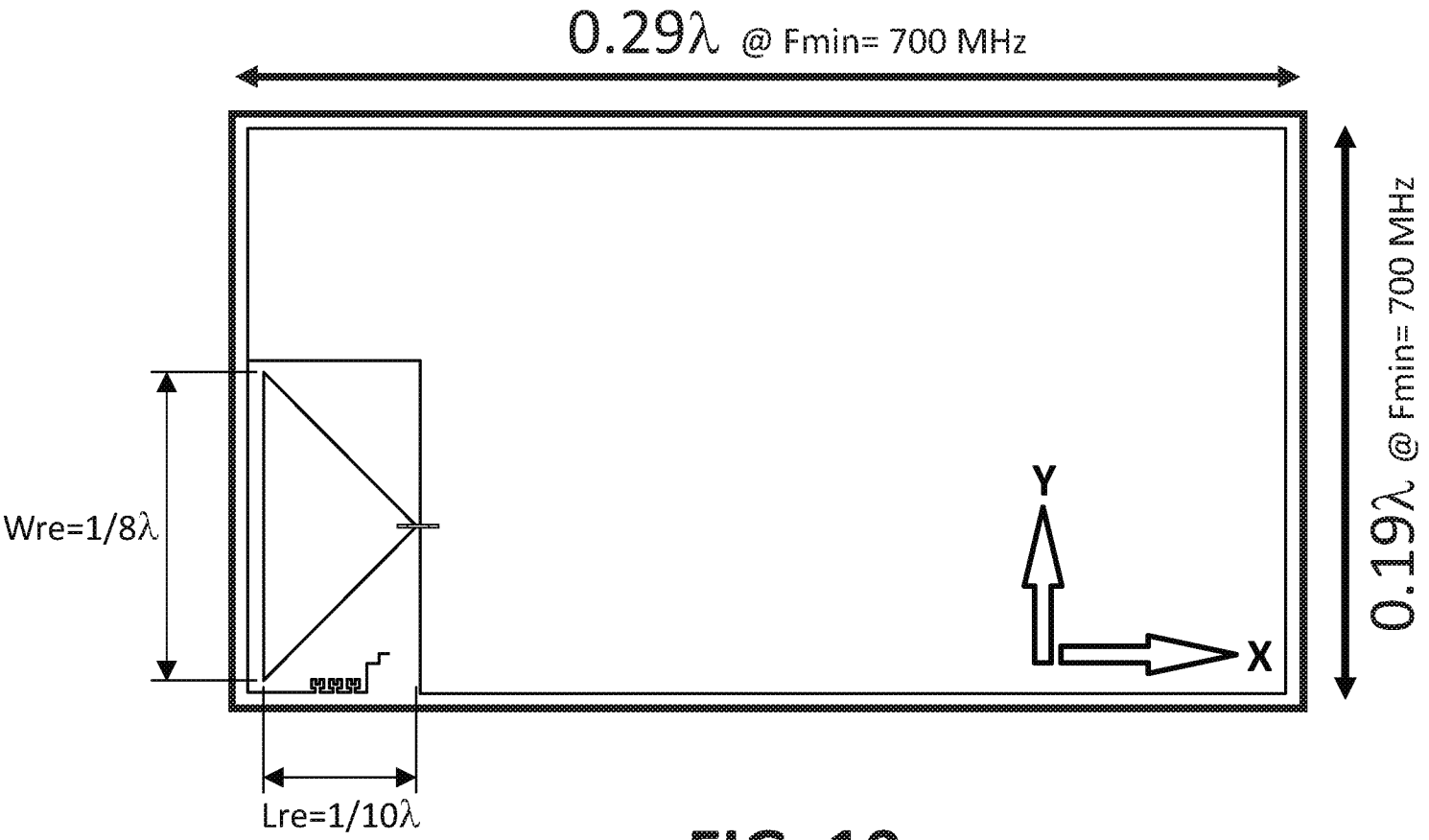
FIG. 10 shows a front view of a broadband antenna system wherein the preferred dimensions of the radiating element and the major and minor sides of the ground plane are indicated.

FIG. 10 shows a preferred embodiment of a broadband antenna system. As indicated, the ground plane 2 is preferably shaped having minor sides 2*b* of 0.19λ, and major sides 2*a* of 0.29λ, being λ the lowest frequency of the LTE frequency band of operation of the antenna system 1, i.e. 700 MHz.

Also, according to a preferred embodiment, the radiating element 4 has a length (Lre) measured from the first side 7 to the first angle 6 greater than 1/10λ, and a width (Wre) measured as the length of the first side 7 of the radiating element 4 greater than 1/8λ, being λ the lowest frequency of the at least one LTE frequency band of operation of the antenna system 1.

Figure 11:
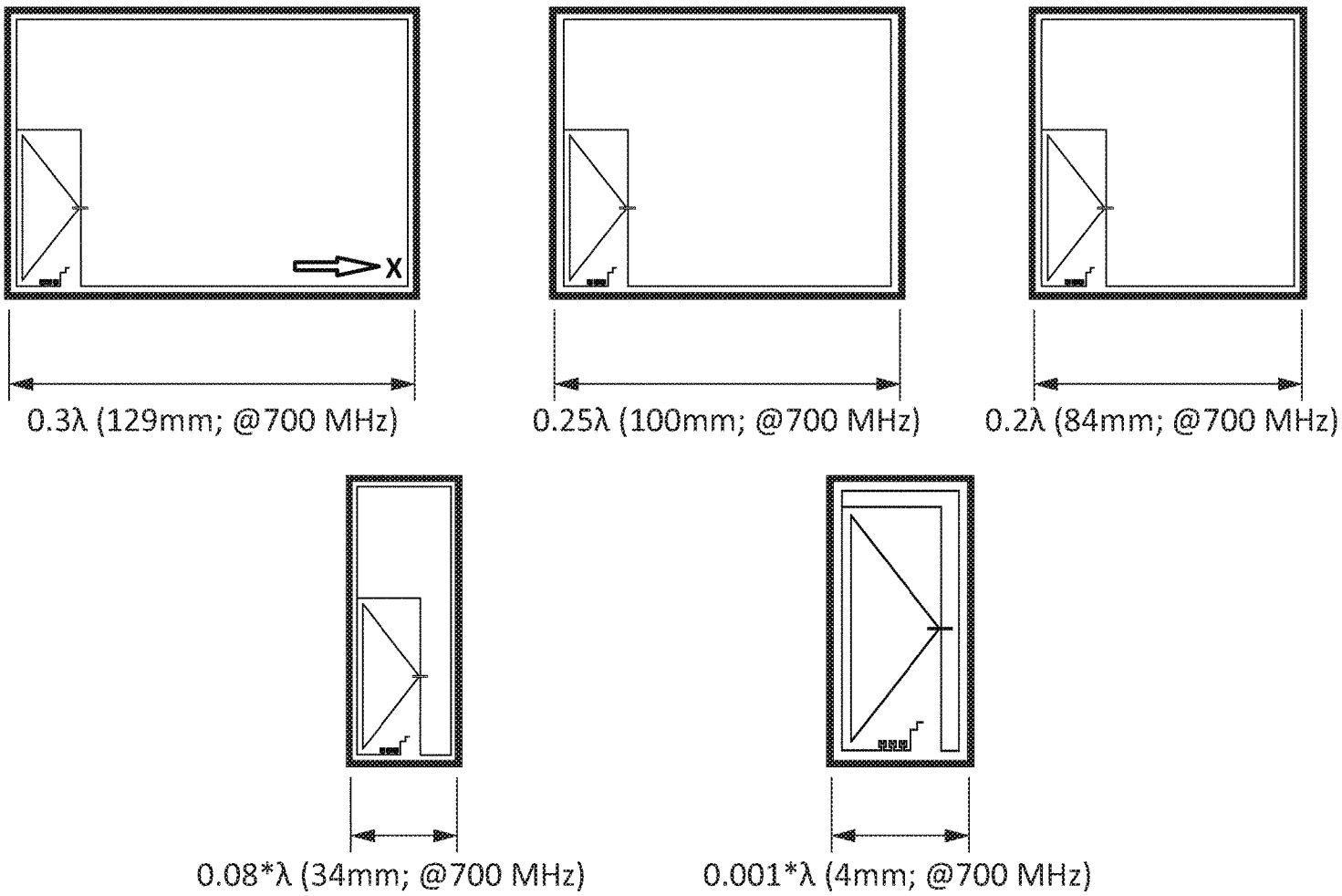
FIG. 11 shows several embodiments of the broadband antenna system of the invention, wherein the major dimension of the ground plane (X axis of FIG. 10) are progressively reduced starting from 0.3λ (129 mm at 700 MHz).

FIG. 11 shows several embodiments of the broadband antenna system of FIG. 2, wherein the major sides 2*a* of the ground plane 2 (X axis of FIG. 10) are progressively reduced. The embodiments start having major sides 2*a* of 0.3λ (129 mm at 700 MHz), then major sides 2*a* are reduced to 0.25λ (20 mm of reduction, i.e. having a length of 109 mm), to 0.2λ (45 mm of reduction, i.e. having a length of 84 mm), to 0.08λ, (95 mm of reduction, i.e. having a length of 34 mm), and to 0.001λ (125 mm of reduction, i.e. having a length of 4 mm).

Figure 12:
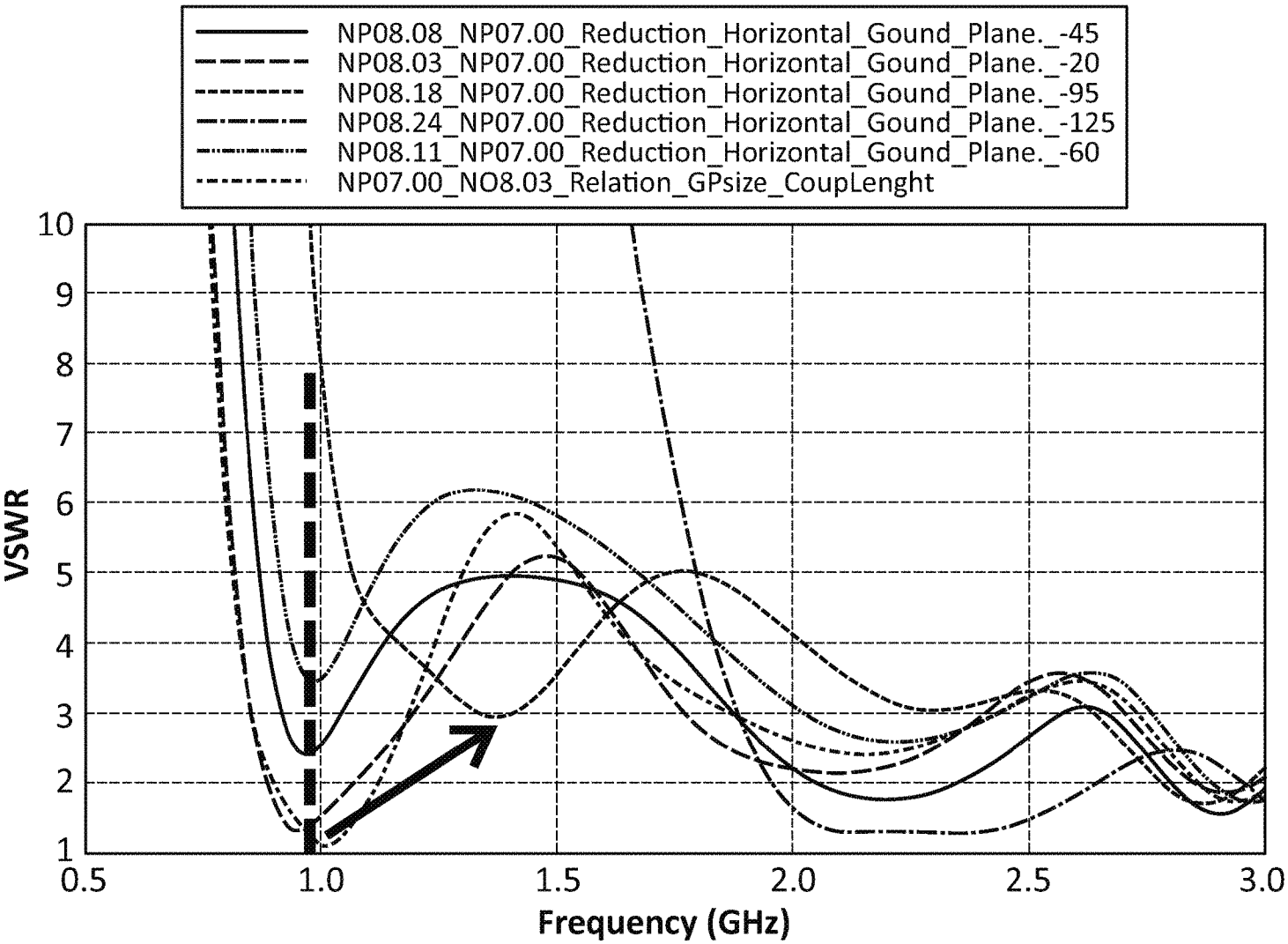
FIG. 12 shows a graphic of the VSWR's of the broadband antenna system of FIG. 11.

FIG. 12 shows the VSWR results of the different embodiments of ground planes of the antenna system shown in FIG. 11. As shown, when the ground plane is reduced greater than 60 mm, the VSWR of the antenna system goes outside specification at lower frequencies, and thus limiting the minimum size of the ground plane of the antenna system.

For that, the major sides 2*a* of the ground plane 2 have to be greater than 0.13λ, being λ the lowest frequency of operation of the antenna system, since, this way, at the lowest frequency band, i.e. 700 MHz (λ=430 mm), the major sides 2*a* of the ground plane 2 would be around 55 mm.

Figure 13:
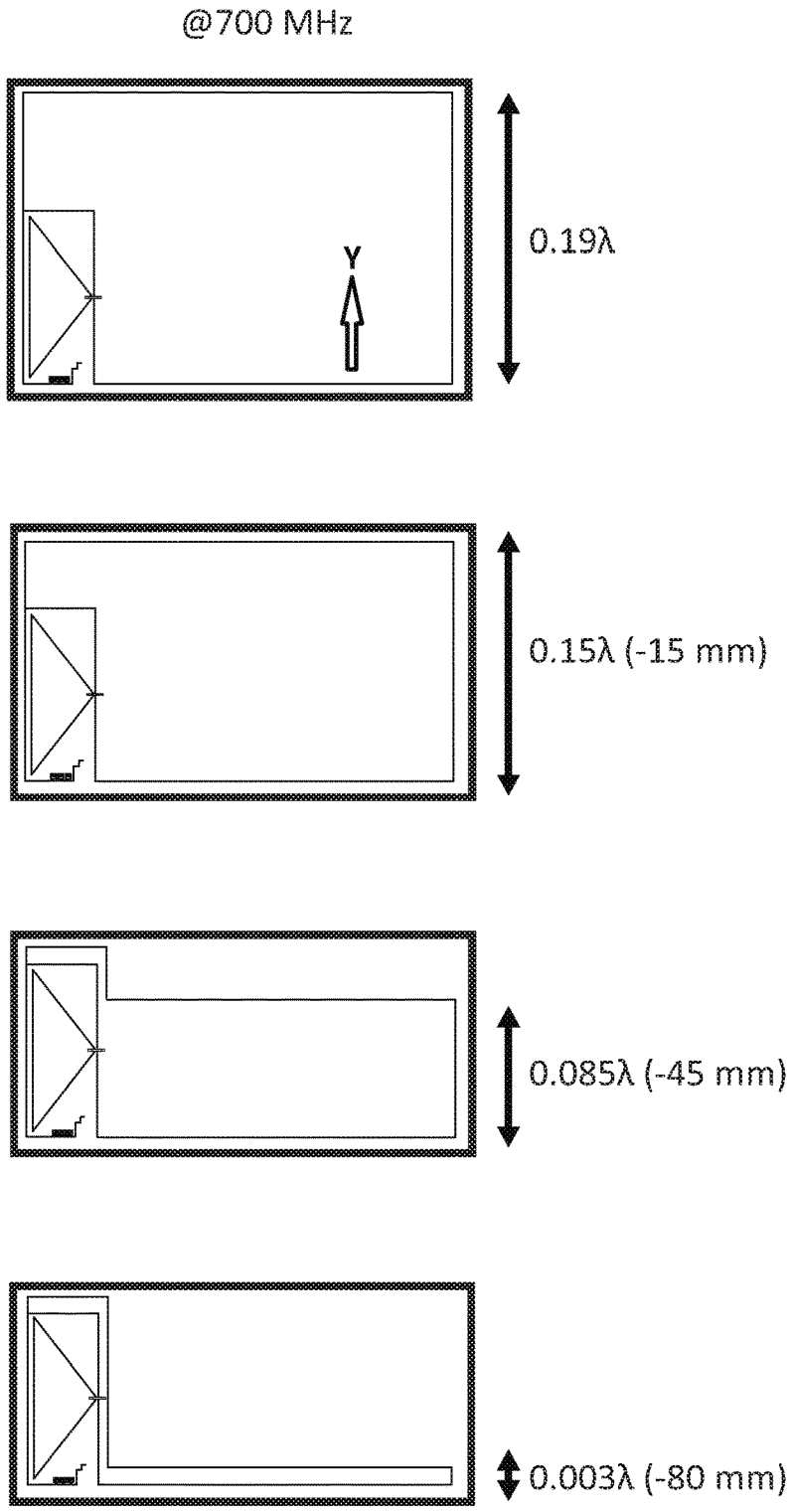
FIG. 13 shows several embodiments of the broadband antenna system of the invention, wherein the minor dimension of the ground plane (Y axis of FIG. 10) are progressively reduced starting from 0.3λ (129 mm at 700 MHz).

FIG. 13 shows several embodiments of the broadband antenna system of FIG. 2, wherein the minor sides 2*b* of the ground plane 2 (Y axis of FIG. 10) are progressively reduced. The embodiments start having minor sides 2*b* of 0.19λ, (81 mm at 700 MHz), then minor sides 2*b* are reduced to 0.15λ (15 mm of reduction, i.e. having a length of 66 mm), to 0.085λ (45 mm of reduction, i.e. having a length of 36 mm)), to 0.003λ (80 mm of reduction, i.e. having a length of 1 mm).

Figure 14:
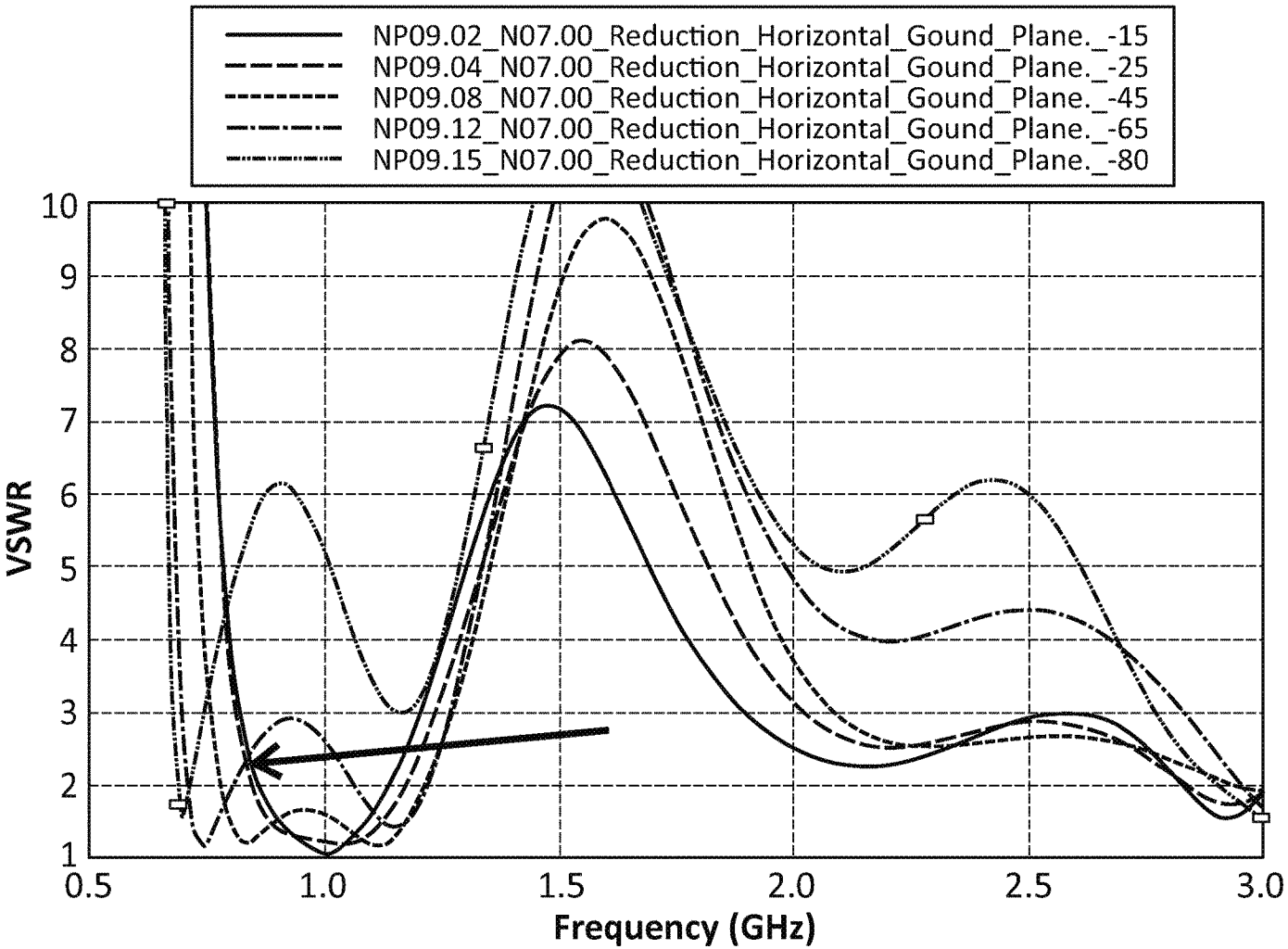
FIG. 14 shows a graphic of the VSWR's of the broadband antenna system of FIG. 13.

As shown in FIG. 14, the minor sides 2*b* configuration are no a limiting parameter, since the broadband antenna system operates at all possible electric dimensions of minor sides 2*b*.

According to the preferred embodiment, the radiating element 4 has at least three angles and three sides, wherein a first side 7 is aligned with the minor side 2*b* of the ground plane 2, and a first angle 6 is the angle whose apex is the closest point of the radiating element 4 to the ground plane 2. In the figure, the first side 7 is the longer side of the radiating element 4, and the first angle 6 is lower than 156°.

Figure 15:
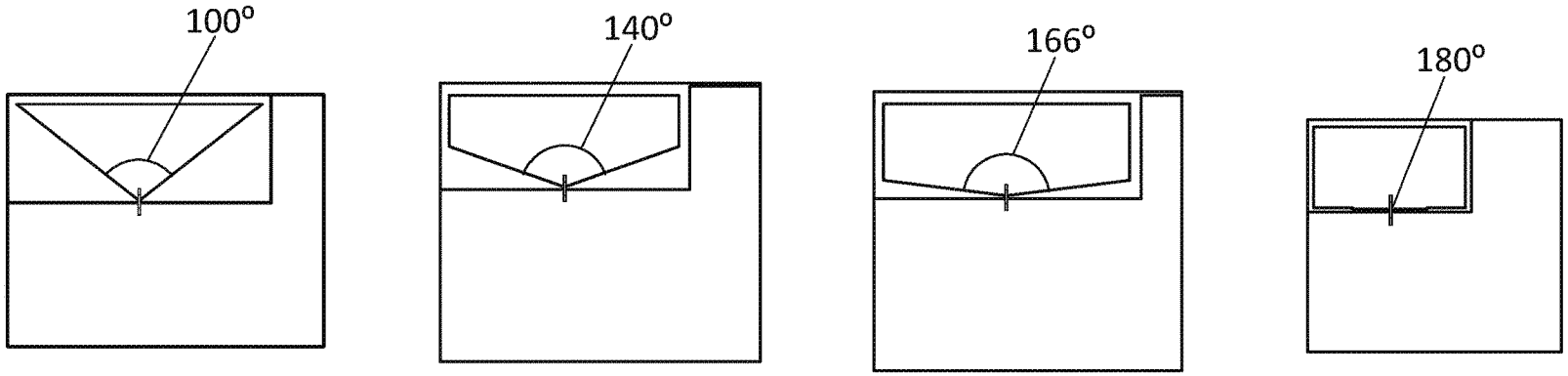
FIG. 15 shows several embodiments of the broadband antenna system of the invention, wherein the first angle of the radiating element is progressively increased starting from 100°.

FIG. 15 shows several embodiments of the broadband antenna system of FIG. 2, wherein the first angle 6 of the radiating element is progressively increased. This first angle makes that currents flowing through each side of the radiating element are decoupled enough from the ground plane, achieving thus an optimum performance.

Figure 16:
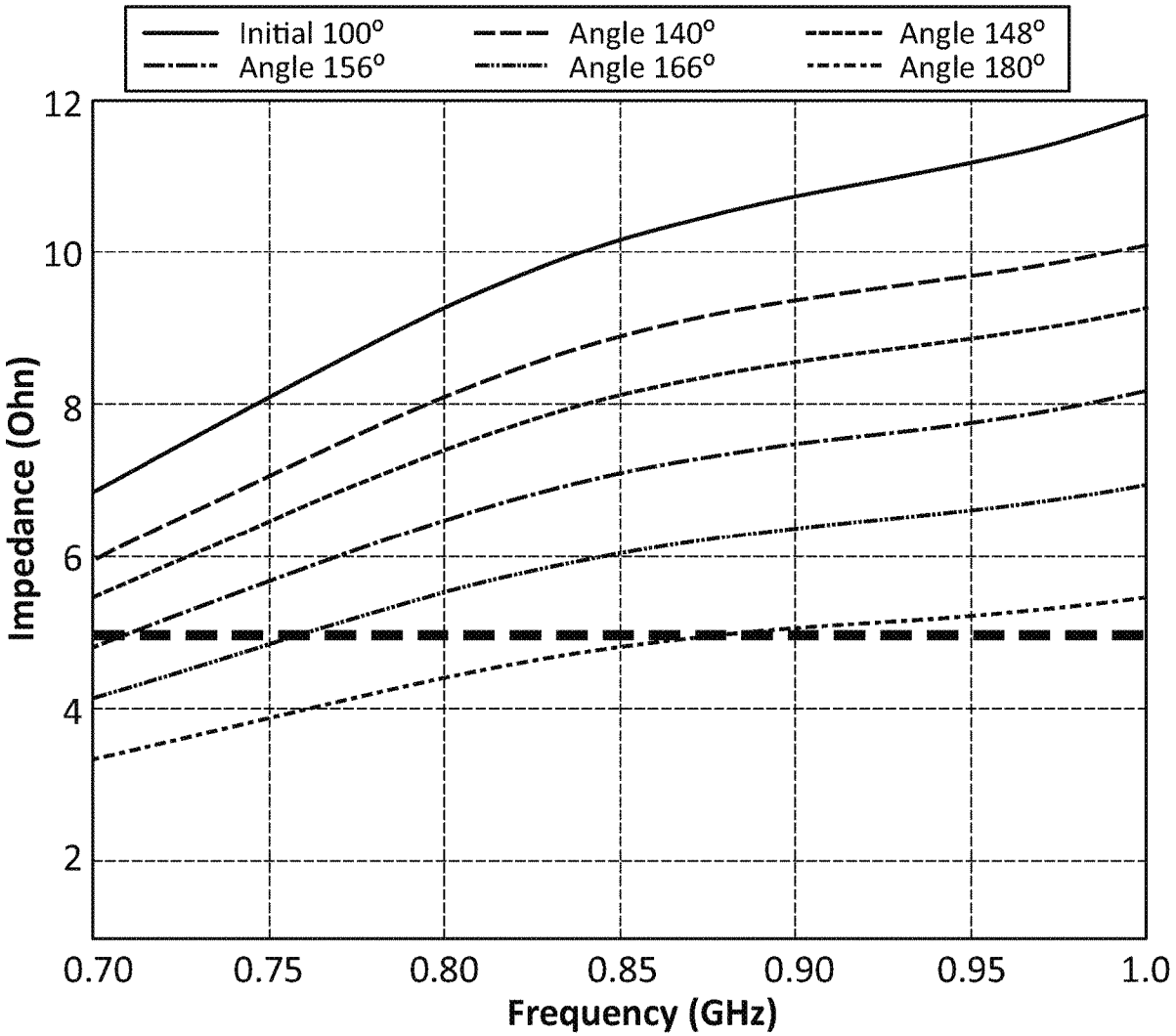
FIG. 16 shows a graphic of the impedance of the broadband antenna system of FIG. 15.

The first angle of the radiating element has a direct effect on the real part of the impedance of the antenna system. For that, FIG. 16 shows a graphic of the impedance of the broadband antenna systems of FIG. 15. As known, the real part of the impedance of the antenna is directly related with the efficiency of the antenna. If the real part of the impedance is lower than 5Ω, the efficiency of the antenna will decrease extremely.

As shown, the first angle 6 has to be lower than 156° so as to the real part of the impedance of the antenna system is suitable for offering the mentioned antenna performance.

Figure 17A:
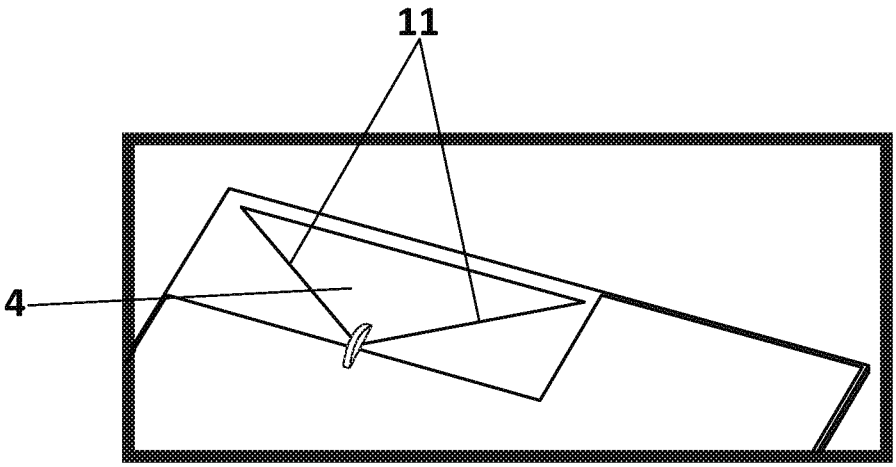
FIGS. 17*a* and 17*b* show front views of different broadband antenna systems, according to preferred embodiments of the invention.
Figure 17B:
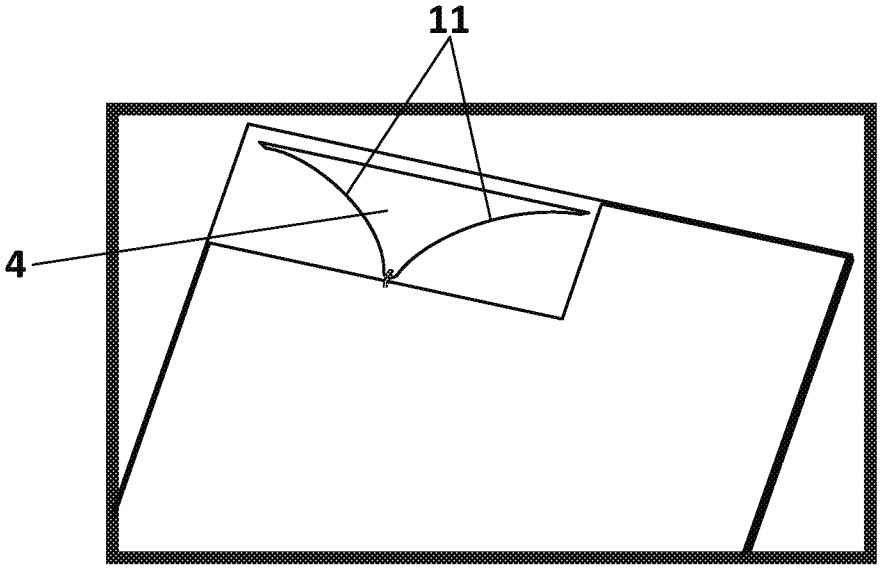

FIGS. 17*a* and 17*b* shows preferred embodiments in which the radiating element 4 has a substantially triangular configuration. In FIG. 17*a*, the radiating element 4 has straight sides 11. In FIG. 17*b*, the radiating element 4 has curved sides 11, in particular, concave-shaped sides.

Preferably, the sum of the electric length (Lgp) of a major side 2*a* of the ground plane 2 and the electric length (Lce) of the conductive element 5 ranges from 0.18×, to 0.22λ, being λ the lowest frequency of the at least one LTE frequency band of operation of the antenna system 1.

Figure 18:
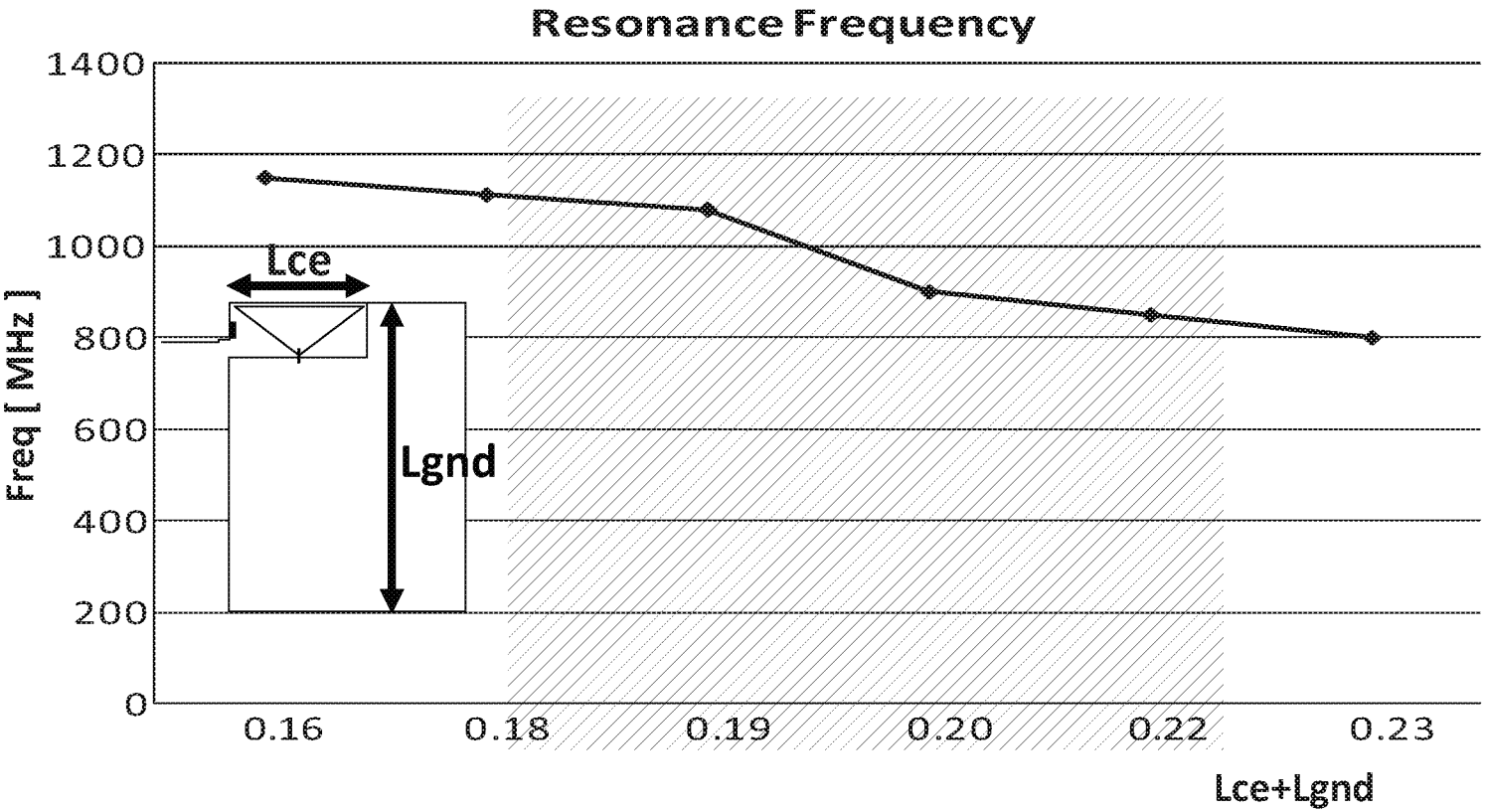
FIG. 18 shows a graphic of the resonant frequency of a broadband antenna system according to the first embodiment of the invention.
Figure 19:
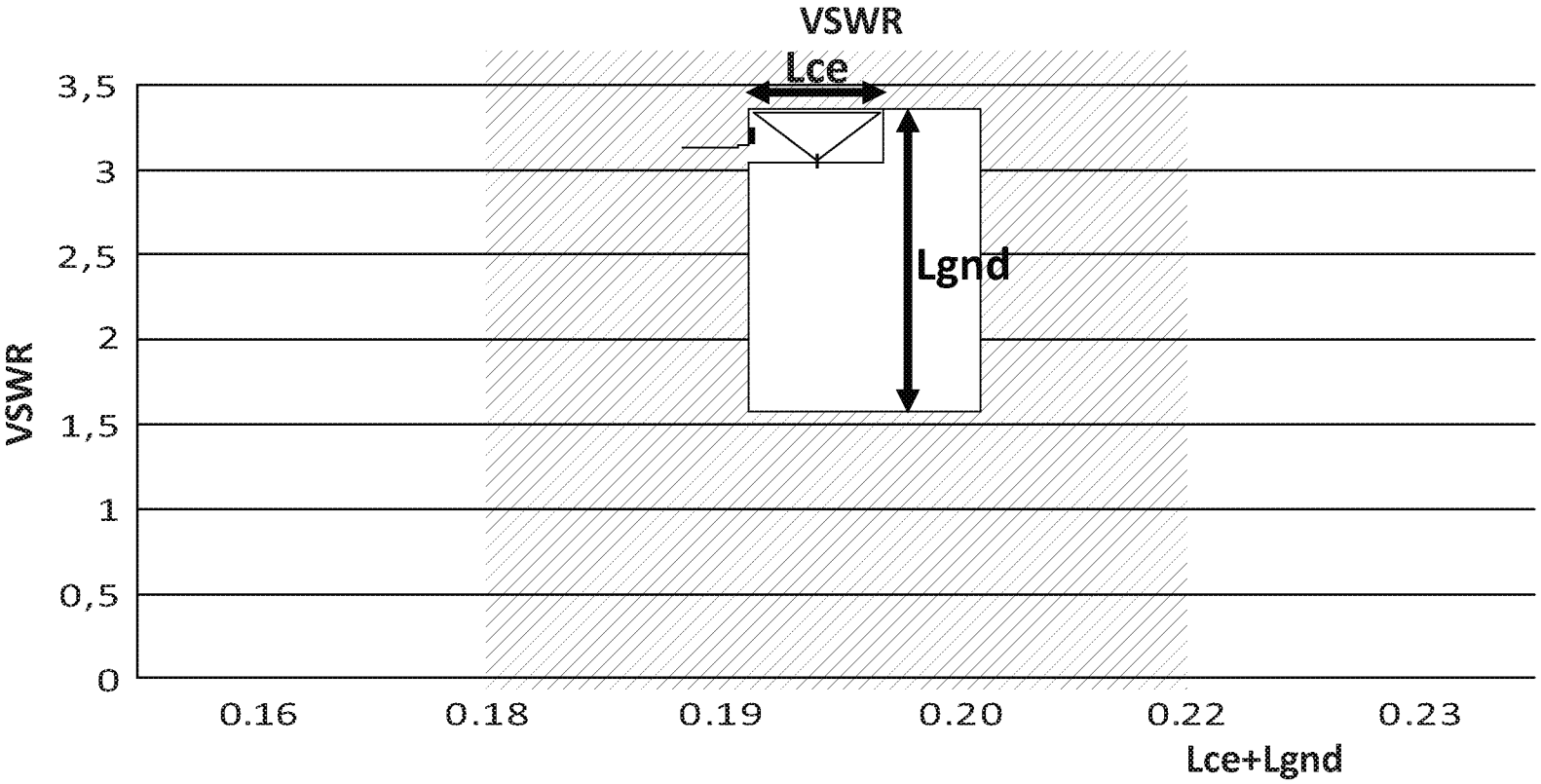
FIG. 19 shows a graphic of the VSWR of a broadband antenna system according to the first embodiment of the invention.

FIGS. 18 and 19 respectively show a graphic of the resonant frequency and the VSWR of the broadband antenna system of FIG. 2. As shown, in the preferred range (0.18λ≤Lgp+Lce≤0.224 the antenna system achieves a VSWR greater than 1.25 and resonant frequencies ranging from 825 MHz to 1100 MHz at the lower frequencies of the LTE frequency band of operation.

According to a third embodiment, the broadband antenna system 1 further comprises at least one additional antenna selected from the group of: a satellite digital audio radio services (SDARS) antenna, a global navigation satellite system (GNSS) antenna, a digital audio broadcasting (DAB) antenna, and an AM/FM antenna.

Figure 20:
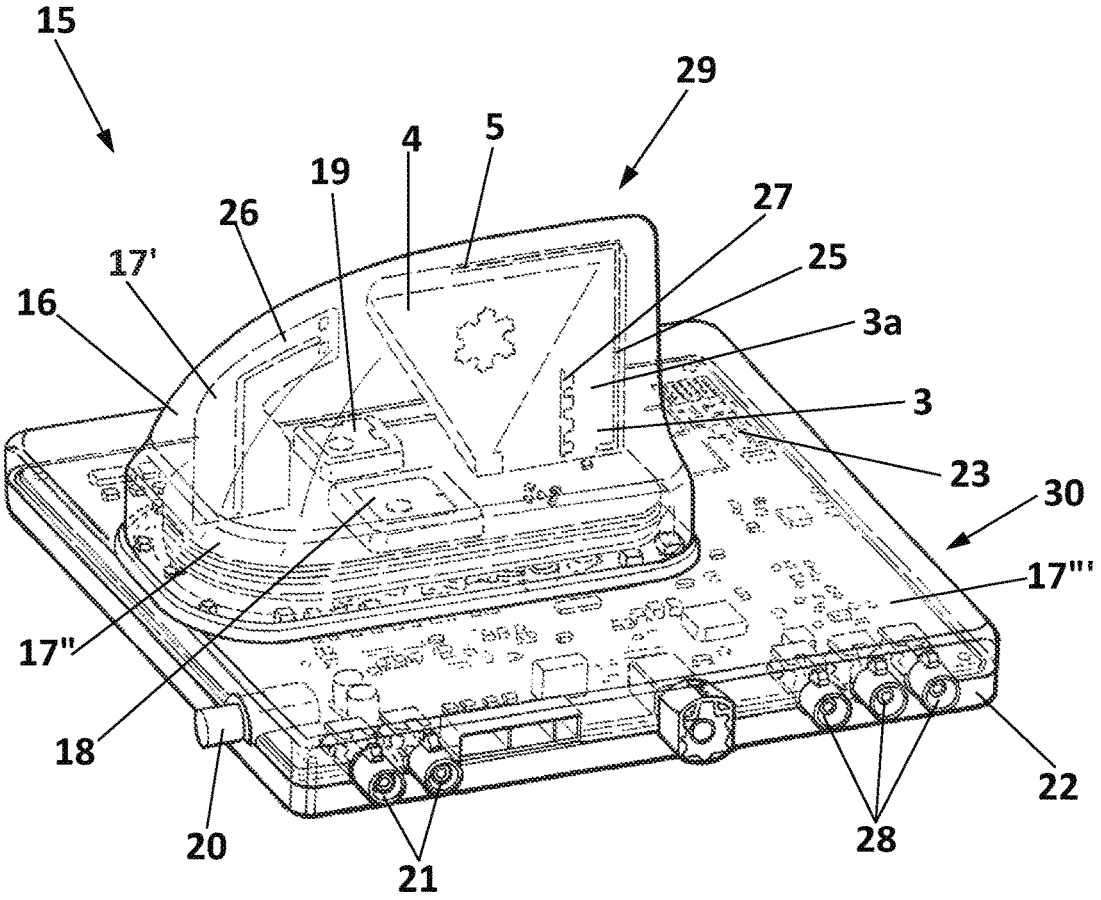
FIG. 20 shows a perspective detailed view of a shark fin antenna comprising the broadband antenna system of the invention, and several antennas for providing different radio-communication services.

FIG. 20 shows a shark fin antenna 15 comprising the broadband antenna system 1, according to another preferred embodiment. The antenna system 1 is covered by a cover 16, and adapted to be attached to the vehicle.

In this third embodiment, the ground plane of the antenna system is an integral part of a vehicle, such as a roof, thus having larger dimensions than the previous embodiments.

As shown in FIG. 20, the shark fin antenna 15 preferably comprises an upper 29 and a lower antenna module 30.

The upper antenna module 29 preferably comprises the first portion area 3*a* of the substrate 3, and first and second additional substrates 17', 17" for allocating the radiating element 4, the conductive element 5, a satellite digital audio radio services (SDARS) 18, a Global navigation satellite system (GNSS) antenna 19, a first 25 and a second 26 DSRC V2X (Dedicated Short-Range Communications Vehicle-to-infrastructure) antennas, and a RKE (Remote Keyless Entry) antenna 27. As shown, the radiating element 4, the conductive element 5, the first DSRC V2X antenna 25, and the RKE antenna 27 are preferably allocated in the first portion area 3*a* of the substrate 3; the second DSRC V2X antenna 26 is preferably allocated in the first additional substrate 17'; and the SDARS 18, and the GNSS antenna 19 is preferably allocated in the second additional substrate 17".

The lower antenna module 30 preferably comprises a third additional substrate 17''' for allocating a WiFi/Bluetooth antenna 23, a digital audio broadcasting (DAB)

antenna connection 20, AM/FM antenna connections 21, and TV connections 28. The third additional substrate 17''' serves as portable support for holding the upper 29 and lower antenna module 30. Further, the third additional substrate 17''' is supported by a base 22, which can be adapted to be fixed to a roof of a vehicle.

This way, the shark fin antenna 15 integrates all these radio-communication services in a single and compact device.

Finally, according to a fourth embodiment, the invention contemplates a vehicle having a roof and a broadband antenna system 1 as described, wherein the substrate 3 of said antenna system 1 is disposed substantially orthogonal to the ground. Preferably, the substrate 3 is enclosed by a cover 16 to form a shark fin antenna 15 for the vehicle.

What is claimed is:

1. A broadband antenna system (1) for a vehicle, comprising:

a ground plane (2) circumscribed by a rectangle having major (2*a*) and minor (2*b*) sides, a dielectric substrate (3) comprising a first portion area (3*a*), a radiating element (4) for operating at at least one frequency band of operation, the radiating element (4) disposed on top of a first portion area (3*a*) of the substrate (3), and having at least three angles and three sides, a first side (7) being substantially aligned with one side (2*a*, 2*b*) of the circumscribed rectangle and a first angle (6) having an apex, the apex being the closest point of the radiating element (4) to the ground plane (2), a grounding point (9) disposed at one extreme of the first portion area (3*a*) of the substrate (3) and coupled to the ground plane (2), a feeding element (8) electromagnetically coupled with the radiating element (4) through the apex of the first angle (6), and a conductive element (5), electrically isolated from the radiating element (4), disposed on the first portion area (3*a*) of the substrate (3) and coupled to the grounding point (9), the conductive element (5) having at least a first portion (5') extending between the radiating element (4) and one of the sides of the first portion area (3*a*) of the substrate (3), wherein each major side (2*a*) of the ground plane (2) has an electric length (Lgp) of at least 0.13λ, with λ being the lowest frequency of the antenna system (1), and wherein the first angle (6) of the radiating element (4) has an aperture lower than 156°, and wherein the conductive element (5) has an electric length (Lce), and wherein the sum of the electric length (Lgp) of the major side (2*a*) of the circumscribed rectangle of the ground plane (2) and the electric length (Lce) of the conductive element (5) ranges from 0.18λ, to 0.22λ.

2. A broadband antenna system (1) for a vehicle, according to claim 1, wherein the radiating element (4) has a length (Lre) measured from the first side (7) to the first angle (6) lower than 1/10λ, and a width (Wre) measured as the length of the first side (7) of the radiating element (4) lower than 1/8λ, being k the lowest frequency of the antenna system (1).

3. A broadband antenna system (1) for a vehicle, according to claim 1, wherein the conductive element (5) is spaced from the radiating element (4) at least 50 μm.

4. A broadband antenna system (1) for a vehicle, according to claim 1, wherein the first portion (5') of the conductive element (5) is bigger than 1/8λ, being k the lowest frequency of the antenna system (1).

5. A broadband antenna system (1) for a vehicle, according to claim 1, wherein the substrate (3) comprises a second portion area (3*b*), and wherein the ground plane (2) is disposed on said second portion area (3*b*).

6. A broadband antenna system (1) for a vehicle, according to claim 1, wherein the radiating element (4) has a substantially triangular configuration.

7. A broadband antenna system (1) for a vehicle, according to claim 1, wherein the radiating element (4) has curved sides (11).

8. A broadband antenna system (1) for a vehicle, according to claim 1, wherein the radiating element (4) has concave-shaped sides.

9. A broadband antenna system (1) for a vehicle, according to claim 1, further comprising a matching network coupling the radiating element (4) with the feeding element (8).

10. A broadband antenna system (1) for a vehicle, according to claim 1, wherein the conductive element (5) has an open extreme shape as a space-filling curve.

11. A broadband antenna system (1) for a vehicle, according to claim 1, further comprising at least one additional antenna selected from the group of: a satellite digital audio radio services (SDARS) antenna, a global navigation satellite system (GNSS) antenna, a digital audio broadcasting (DAB) antenna, and an AM/FM antenna.

12. A broadband antenna system (1) for a vehicle, according to claim 1, wherein the frequency band of operation is the LTE frequency band of operation, and λ corresponds to the lowest frequency of the LTE band, which is 700 MHz.

13. A broadband antenna system (1) for a vehicle, according to claim 12, wherein the LTE frequency band of operation comprises a first band ranging from 700 MHz to 960 MHz, a second band ranging from 1400 MHz to 1500 MHz, a third band ranging from 1700 MHz to 2200 MHz, and a fourth band ranging from 2500 MHz to 2700 MHz.

14. A shark fin antenna (15) comprising a broadband antenna system (1) for a vehicle according to claim 1, further comprising a cover for enclosing at least the first portion area (3*a*) of the substrate (3), and where the antenna system (1) is adapted to be attached to the vehicle.

* * * * *